US005519408A

United States Patent [19]

Schnetzer

[11] Patent Number: 5,519,408

[45] Date of Patent: May 21, 1996

[54] TAPERED NOTCH ANTENNA USING COPLANAR WAVEGUIDE

[76] Inventor: Michel W. Schnetzer, 181 Wetterhorn Way, Longmont, Colo. 80501

[21] Appl. No.: 906,017

[22] Filed: Jun. 26, 1992

Related U.S. Application Data

[63] Continuation of Ser. No. 644,176, Jan. 22, 1991, abandoned.

[51] Int. Cl.[6] ..... H01Q 13/10

[52] U.S. Cl. ..... 343/767; 343/770; 343/771

[58] Field of Search ..... 343/767, 772, 343/786, 747, 859, 865, 771, 770

[56] References Cited

U.S. PATENT DOCUMENTS

| | | | |
|---|---|---|---|
| 2,559,693 | 7/1951 | Willoughby | 343/767 |
| 2,942,263 | 6/1960 | Baldwin | 343/767 |
| 2,944,258 | 7/1960 | Yearout . | |
| 3,836,976 | 9/1974 | Monser et al. | 343/795 |
| 4,425,549 | 1/1984 | Schwartz et al. | 333/239 |
| 4,500,887 | 2/1985 | Nester | 343/700 MS |
| 4,792,810 | 12/1988 | Fukuzawa et al. | 343/700 MS |
| 4,843,403 | 6/1989 | Lalezari et al. | 343/767 |
| 4,853,704 | 8/1989 | Diaz et al. | 343/767 |
| 4,855,749 | 8/1989 | DeFonzo | 343/767 |
| 4,978,965 | 12/1990 | Mohuchy | 343/767 |
| 4,990,926 | 2/1991 | Otsuka et al. | 343/700 MS |
| 5,023,623 | 6/1991 | Kreinheder et al. | 343/770 |
| 5,081,466 | 1/1992 | Bitter, Jr. | 343/767 |
| 5,087,920 | 2/1992 | Tsurumaru et al. | 343/700 MS |
| 5,227,808 | 7/1993 | Davis | 343/767 |

FOREIGN PATENT DOCUMENTS

| | | | |
|---|---|---|---|
| 451213 | 7/1936 | United Kingdom | 343/895 |

*Primary Examiner*—Donald Hajec
*Assistant Examiner*—Hoanganh Le

[57] ABSTRACT

A radiating tapered notch antenna (sometimes known as a Vivaldi antenna) is fed by a section of slotline, which in, turn is fed by a coplanar waveguide. The transition from the unbalanced coplanar waveguide to the balanced slotline is accomplished by an infinite balun, where the center conductor of the coplanar waveguide terminates on the slotline conductor opposite the ground conductor of the coplanar waveguide. One slot of the coplanar waveguide becomes the feeding slotline for the notch, and the other slot terminates in a slotline open circuit. All of the elements of the system are coplanar.

2 Claims, 9 Drawing Sheets

VIVALDI ANTENA ELEMENT-
ISOLATE ELEMENT PATTERN E-PLANE 900 MHz

VIVALDI ANTENA ELEMENT-
ISOLATE ELEMENT PATTERN H-PLANE 900 MHz

VIVALDI ANTENA ELEMENT-
ISOLATE ELEMENT PATTERN H-PLANE 1.0 GHz

VIVALDI ANTENA ELEMENT-
ISOLATE ELEMENT PATTERN E-PLANE 1.4 GHz

VIVALDI ANTENA ELEMENT-
ISOLATE ELEMENT PATTERN H-PLANE 1.4 GHz

TAPERED NOTCH ANTENNA USING COPLANAR WAVEGUIDE

STATEMENT OF GOVERNMENT INTEREST

The invention described herein may be manufactured and used by or for the Government for governmental purposes without the payment of any royalty thereon.

This application is a continuation of application Ser. No. 07/644,176, filed 22 Jan. 1991 now abandoned.

This invention is for a radiating tapered notch antenna which is entirely coplanar. The invention finds particular utility as the radiating elements in a very large (400 to 1200 m2) wide-band (40 percent) L-band corporate fed Space Based Radar, and more particularly in a deployable phased array antenna in which the subarrays of the antenna are compressed together in a stowed configuration. The use of the tapered notch antenna using a coplanar waveguide feed, and having no ground plane provides an efficient antenna system capable of compact storage prior to deployment. Because of the use of the radiators disclosed herein, it is feasible to provide a deployed antenna which measures 86'×149' and contains over. 73,000 radiating elements in a space measuring only 8.5'×9.4'×27' and therefore capable of being loaded into the current space shuttles.

BACKGROUND OF THE INVENTION

The Vivaldi tapered notch, or horn, is printed on films of Kapton or other very thin dielectric. Printing is accomplished by standard printed circuit techniques whereby the Kapton material is coated with copper or other conductor. The horn and the feed network, including waveguides and impedance matching slot line baluns are produced by photo-etching. Since most of the copper remains on the dielectric film, it contributes to the stiffness of the device without which the device would not be self-supporting, and it provides a heat dissipation path and significant radiating area for thermal control of the T/R modules.

Briefly stated, the invention provides a radiating tapered notch antenna (sometimes known as a Vivaldi antenna) which is fed by a section of slotline, which in turn is fed by a coplanar waveguide. The transition from the unbalanced coplanar waveguide to the balanced slotline is accomplished by an infinite balun, where the center conductor of the coplanar waveguide terminates on the slotline conductor opposite the ground conductor of the coplanar waveguide. One slot of the coplanar waveguide becomes the feeding slotline for the notch, and the other slot terminates in a slotline open circuit. All of the elements of the system are coplanar.

U.S. Pat. No. 4,853,704 issued on Aug. 1, 1989 to Diaz et al, discloses a tapered notch, printed circuit antenna assembly having a strip conductor, and a ground plane separated from and lying parallel to the strip conductor. The ground plane has a slot which extends transverse to the strip conductor. The antenna comprises a conductive planar element positioned across the slot and orthogonal to the ground plane, and has curved surfaces extending upward and outwardly from the slot. The strip conductor or microstrip and the slot-containing ground plane are separated by a dielectric material. This invention is an improvement over Diaz in that the ground plane is eliminated, and in that all of the components are coplanar.

In designing an antenna for radio frequency energy it is important that the antenna be compatible with the feeding network, that is, the transitional device that is to be employed between the antenna element and the feed means to excite the element should be one with little or no discontinuity that would cause bandwidth restrictions.

In seeking a broadband antenna compatible with a feed network, light in weight, rugged in construction and yet simple to construct, the choices available to an antenna engineer are rather limited. In designing an antenna along with any necessary impedance-matching or power-dividing circuit component associated therewith, an antenna designer must make the antenna perform a desired electrical function which includes, among other things, transmitting/receiving linearly polarized, right-hand circularly polarized, left-hand circularly polarized, etc., R. F. signals with appropriate gain, bandwidth, beam width, minor lobe level, radiation efficiency, aperture efficiency, receiving cross section, radiation resistance as well as other electrical characteristics.

It is advantageous for an antenna structure to be lightweight, simple in design, and inexpensive. The Vivaldi, or tapered notch antenna, is advantageous since it can be constructed by simple photo-etching techniques well-known in the art. Such techniques offer ease of fabrication at a relatively low production cost. Briefly, the tapered notch antenna is formed by etching a single side of a unitary metal clad dielectric sheet or electrodeposited film using conventional photoresist-etching techniques. Typically, the entire antenna structure may possibly be only 1/32 inch to 1/8 inch thick which minimizes cost and maximizes manufacturing/operating reliability and reproducibility.

It can be appreciated that the cost of fabrication of such printed circuit board antennas is substantially minimized since single antenna elements and/or arrays of such elements together with appropriate R. F. feed lines, phase shifting circuits and/or impedance matching networks may all be manufactured as one integrally formed electrical circuit by using low cost photoresist-etching processes commonly used to make electronic printed circuit boards.

RELATED PRIOR PATENTS

Antennas of the type considered herein, viz., flared notch type antenna, have been configured in various forms. Briefly, U.S. Pat. No. 2,942,263 to Baldwin teaches a conventional notch antenna device. U.S. Pat. No. 2,944,258 to Yearout, et al., discloses a dual-ridge antenna as previously disclosed having a broad bandwidth. U.S. Pat. No. 3,836,976 to Monser, et al., discloses a broadband phased array antenna formed by pairs of mutually orthogonal printed radiating elements, each one of such elements having a flared notch formed thereon. U.S. Pat. No. 4,500,887 to Nester discloses a broadband radiating element designed to provide a smooth, continuous transition from a microstrip feed configuration to a flared notch antenna. U.S. Pat. No. 4,843,403 discloses another dual notch antenna.

OBJECTS OF THE INVENTION

It is an object of this invention to provide a broadband, lightweight, low cost antenna for a space antenna consisting of a radiating tapered notch radiating element, a coplanar waveguide input, and a coplanar slotline open circuit forming the infinite balun section.

Another object of this invention is to provide a Vivaldi type antenna wherein the radiator and transition are printed on a single planar circuit board, thereby reducing size of the system, eliminating assembly, and reducing costs.

BRIEF DESCRIPTION OF THE DRAWINGS

For further objects, and for a better understanding of the nature and the scope of this invention, reference should now be made to the following detailed specification and to the accompanying drawings, in which.

DESCRIPTION OF A PREFERRED EMBODIMENT

Figure 1:
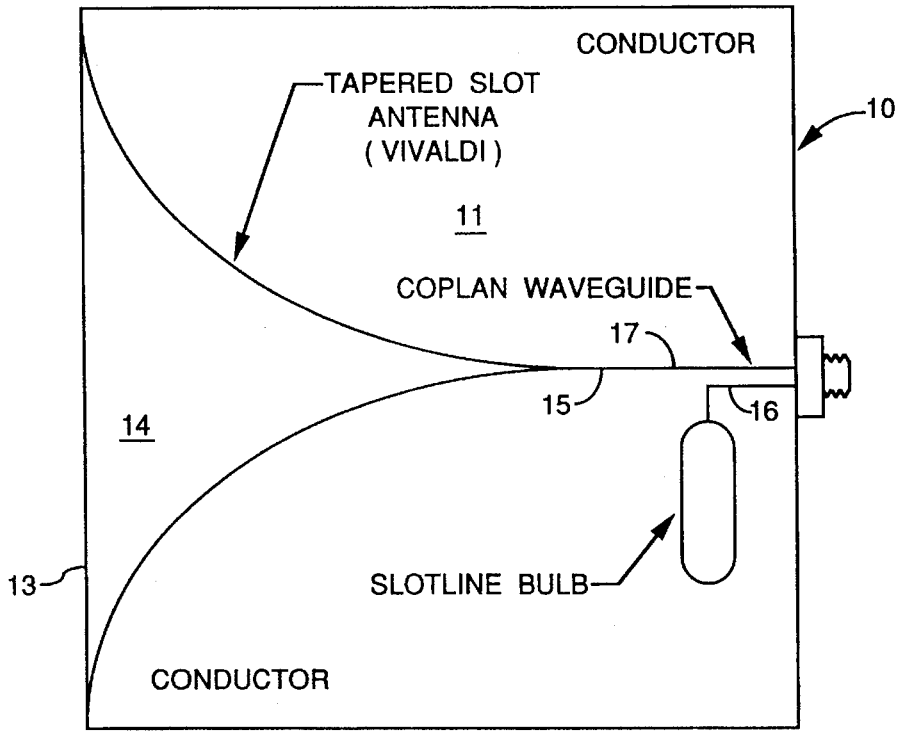
FIG. 1 is a schematic diagram of a preferred embodiment of the invention.

Referring to FIG. 1, the tapered notch antenna 10 of this invention is shown in its simplest form as consisting of a conductor 11 integrally applied to a dielectric substrate 13. The tapered notch antenna 10 has a mouth 14 and a narrow balanced slot line 15 that are interconnected by a gradual transition as shown. The antenna 10 (sometimes known as a Vivaldi antenna) is fed by the section of slotline 15, which in turn is fed by a coplanar waveguide 16. The transition from the unbalanced coplanar waveguide 16 to the balanced slotline is accomplished by an infinite balun 17, where the center conductor of the coplanar waveguide terminates on the slotline conductor opposite the ground conductor of the coplanar waveguide. One slot of the coplanar waveguide becomes the feeding slotline for the notch, and the other slot terminates in a slotline open circuit, i.e., a slot line bulb balun 20. All of the elements of the system are coplanar. R. F. is applied to the antenna through a connector 22.

The substrate 13 may be composed of a dielectric or ceramic material PTFE composite, fiberglass reinforced with cross linked polyolefins, alumina and the like. Preferably, the antenna is made by electro-chemical deposition of copper on a substrate comprised of a thin film of Kapton or other suitable dielectric, and then the Vivaldi "horn", the waveguides and the impedance matching devices are formed by photo resist etching.

The antennas are designed so that the Vivaldi horn and the coplanar waveguide feed network and the impedance matching is formed on the substrate so that copper will remain on most of the substrate. Since the Kapton is a very thin film, this arrangement provides sub-array stiffness and a significant radiating area for thermal control of the T/R modules. The copper coating on the thin Kapton film renders the combination self-supporting.

On one surface of the substrate, a first and second metallizations 22 and 23, respectively, are bonded thereto and spaced apart as shown. The first and second metallizations, 22 and 23, have adjacent and facing edges 24 and 25 that extend across the surface of substrate 21 and curve outwardly and remain spaced apart. It should be appreciated that the edges 24 and 25 are very thin since the metallizations are generally deposited by electrochemical deposition, generally having a thickness of about 0.0015 inch or less.

Figure 3:
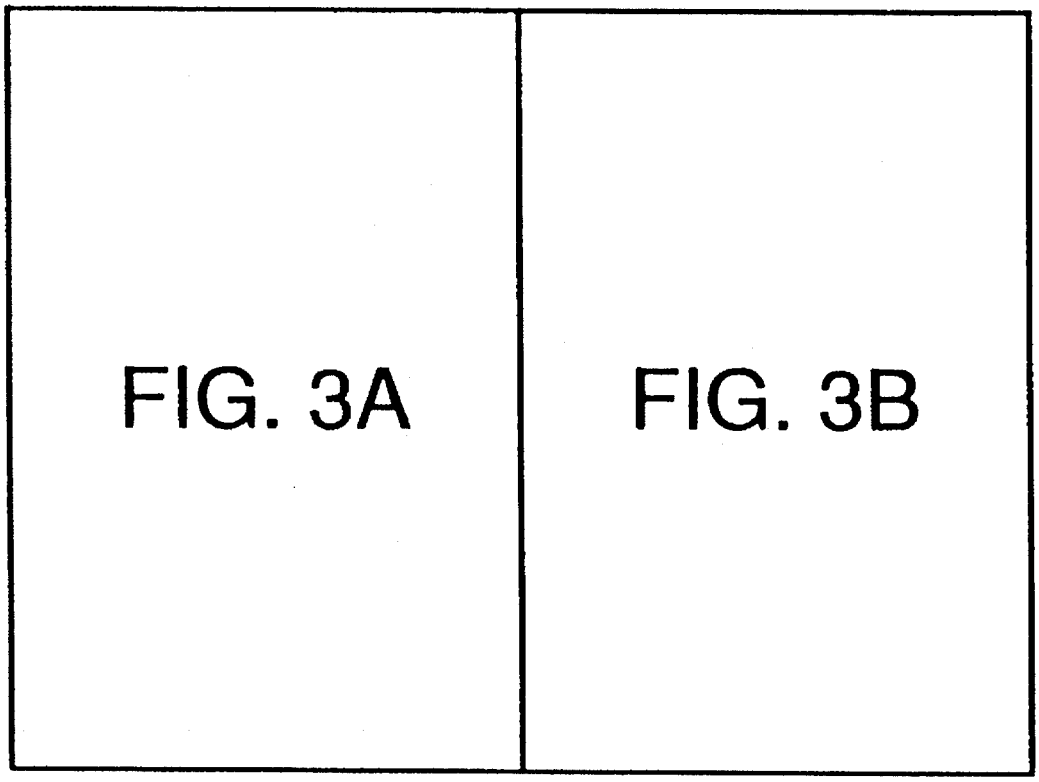
FIG. 3 is a block diagram that indicates how FIGS. 3A and 3B fit together to form Smith chart that shows the measured impedance of a exemplary embodiment of this invention.
Figure 3A:
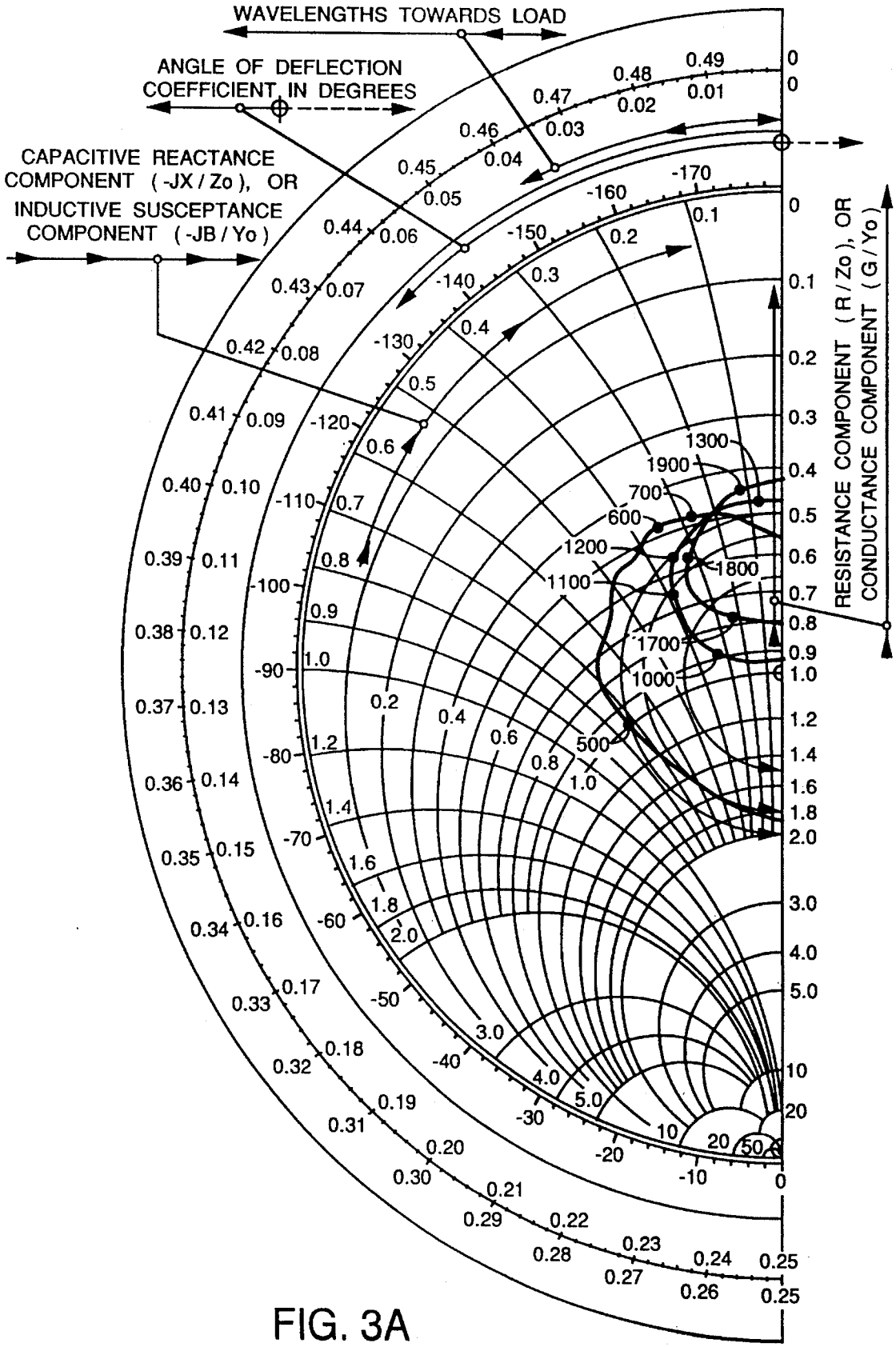
Figure 3B:
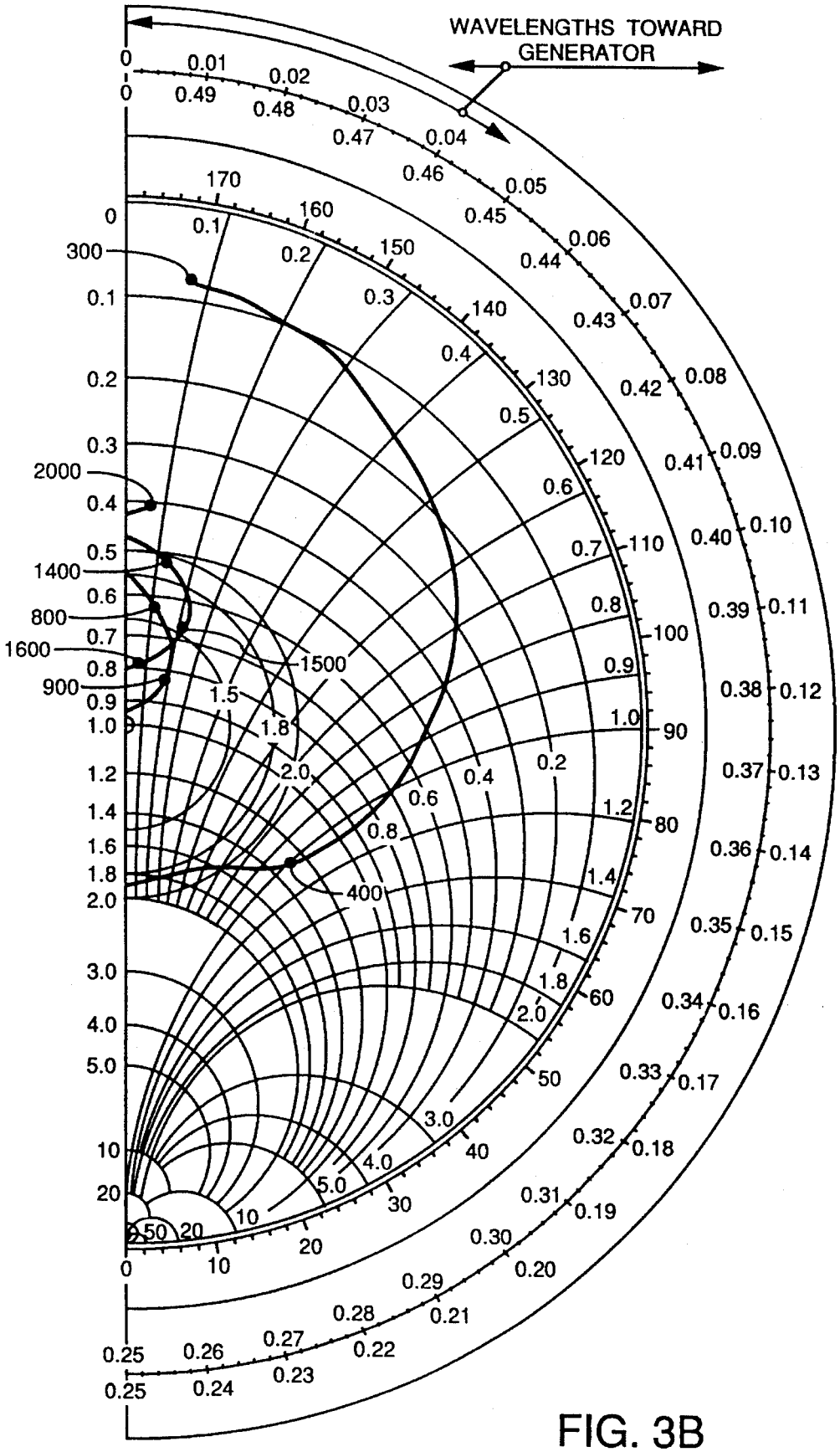
Figure 4:
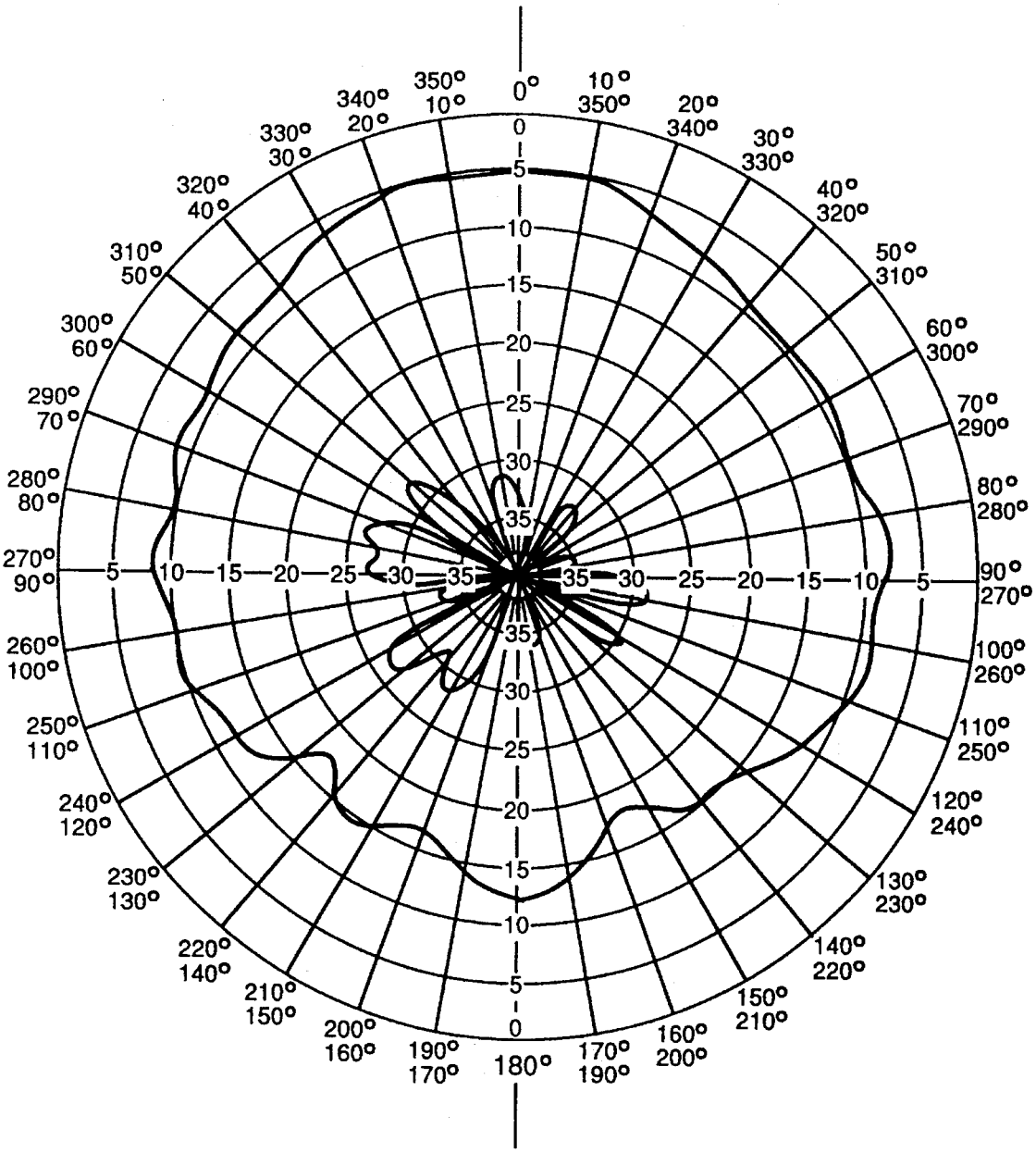
FIGS. 4 through 8 show radiation patterns for a single element of the antenna.
Figure 5:
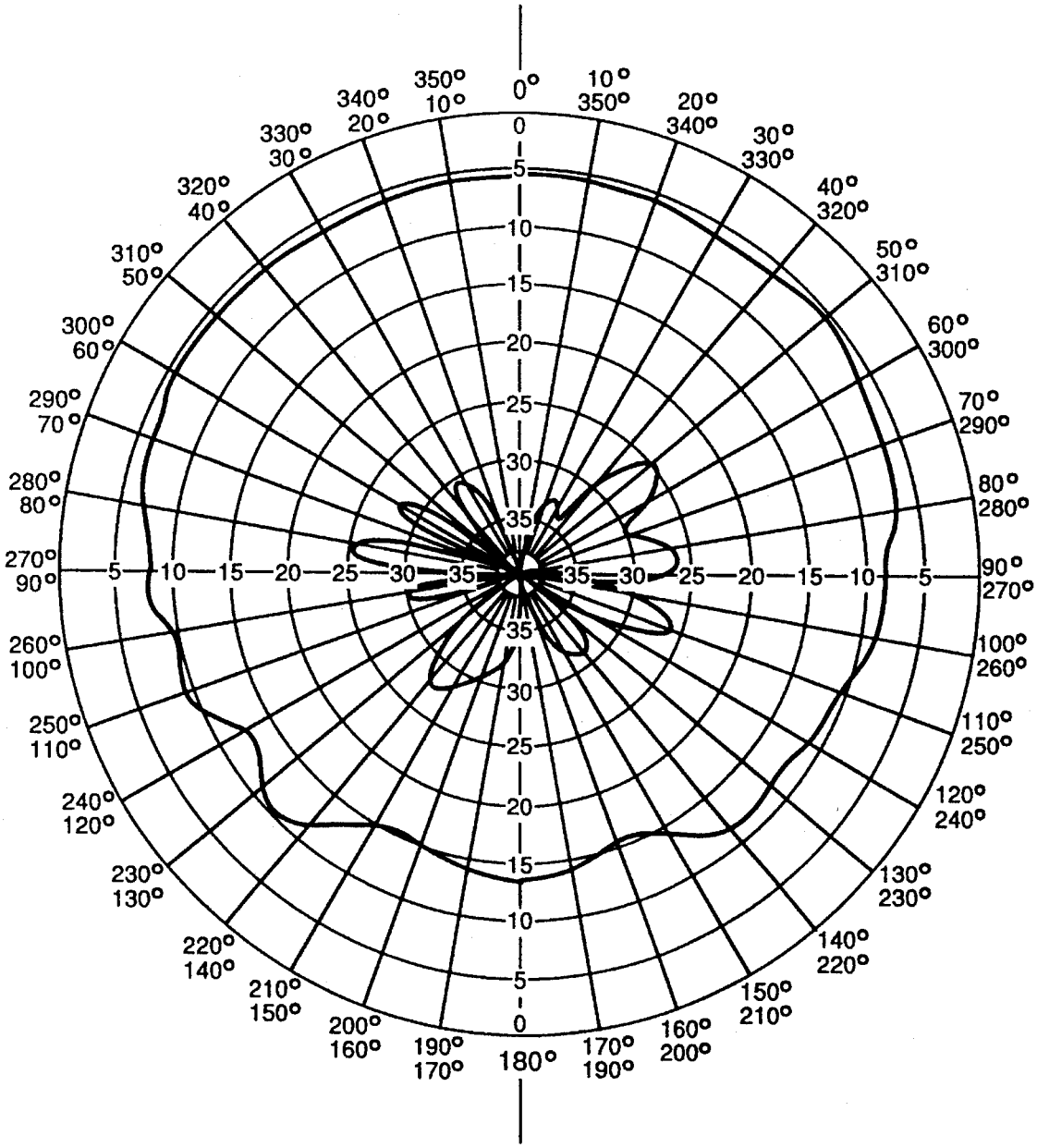
Figure 6:
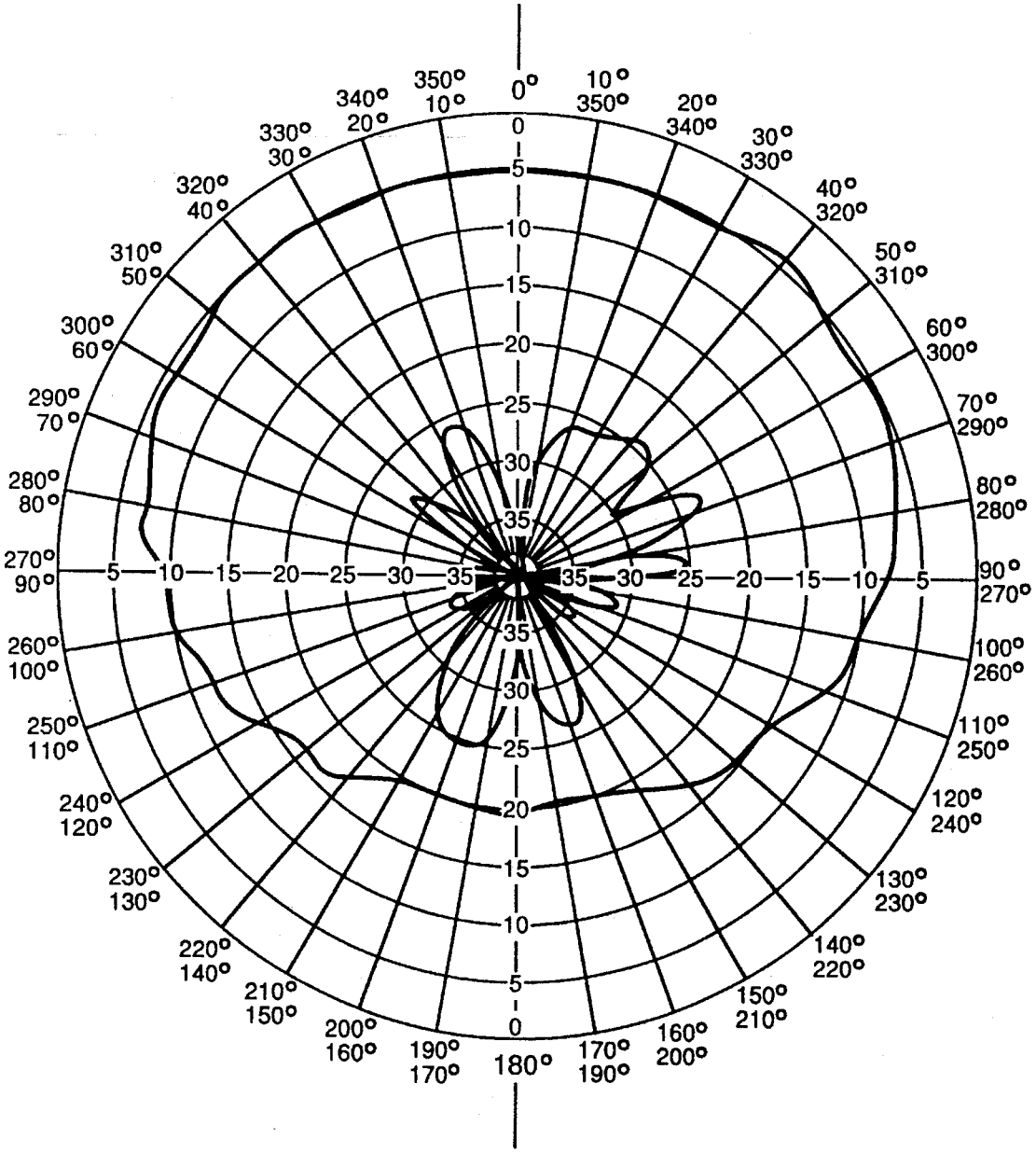
Figure 7:
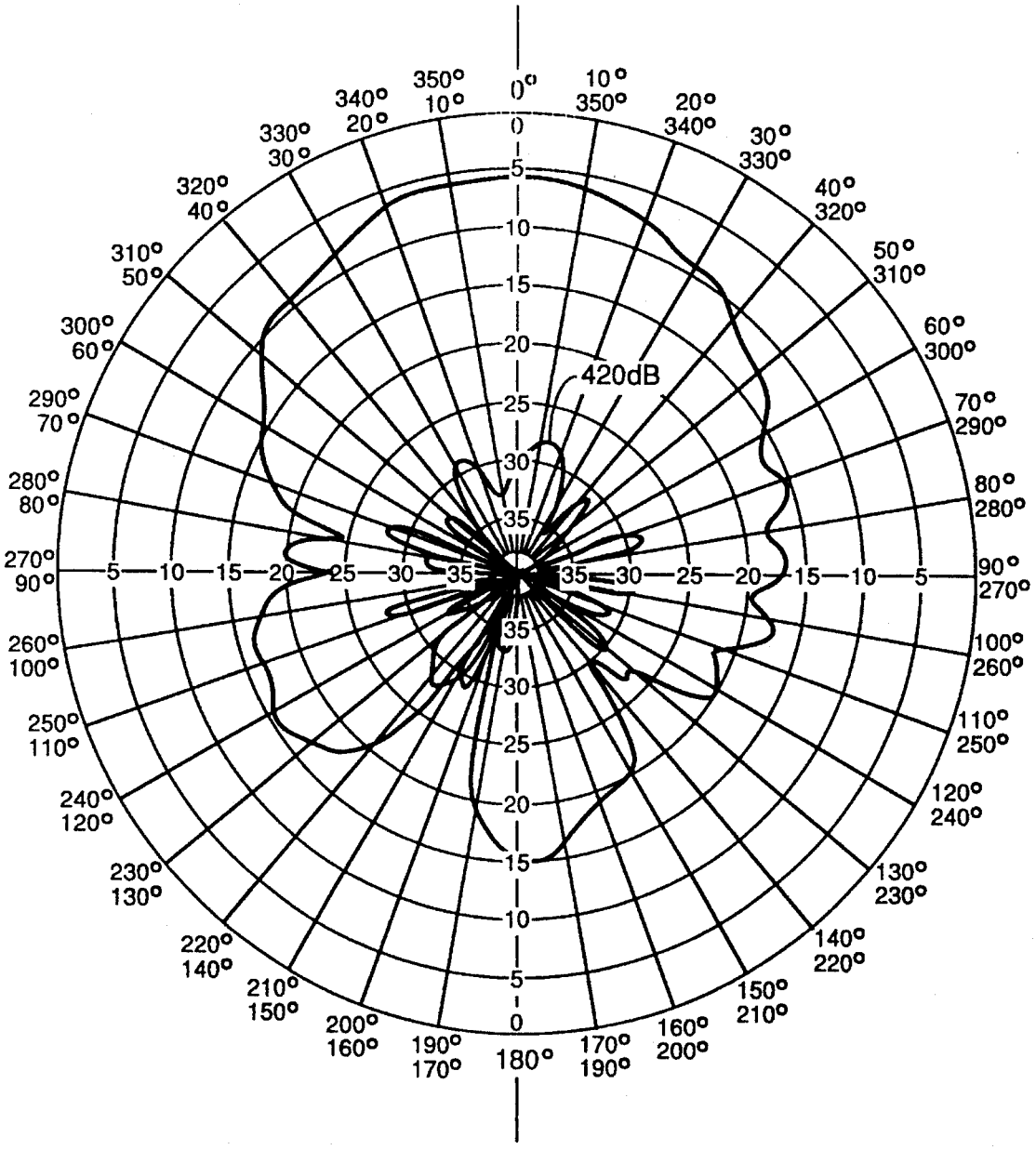
Figure 8:
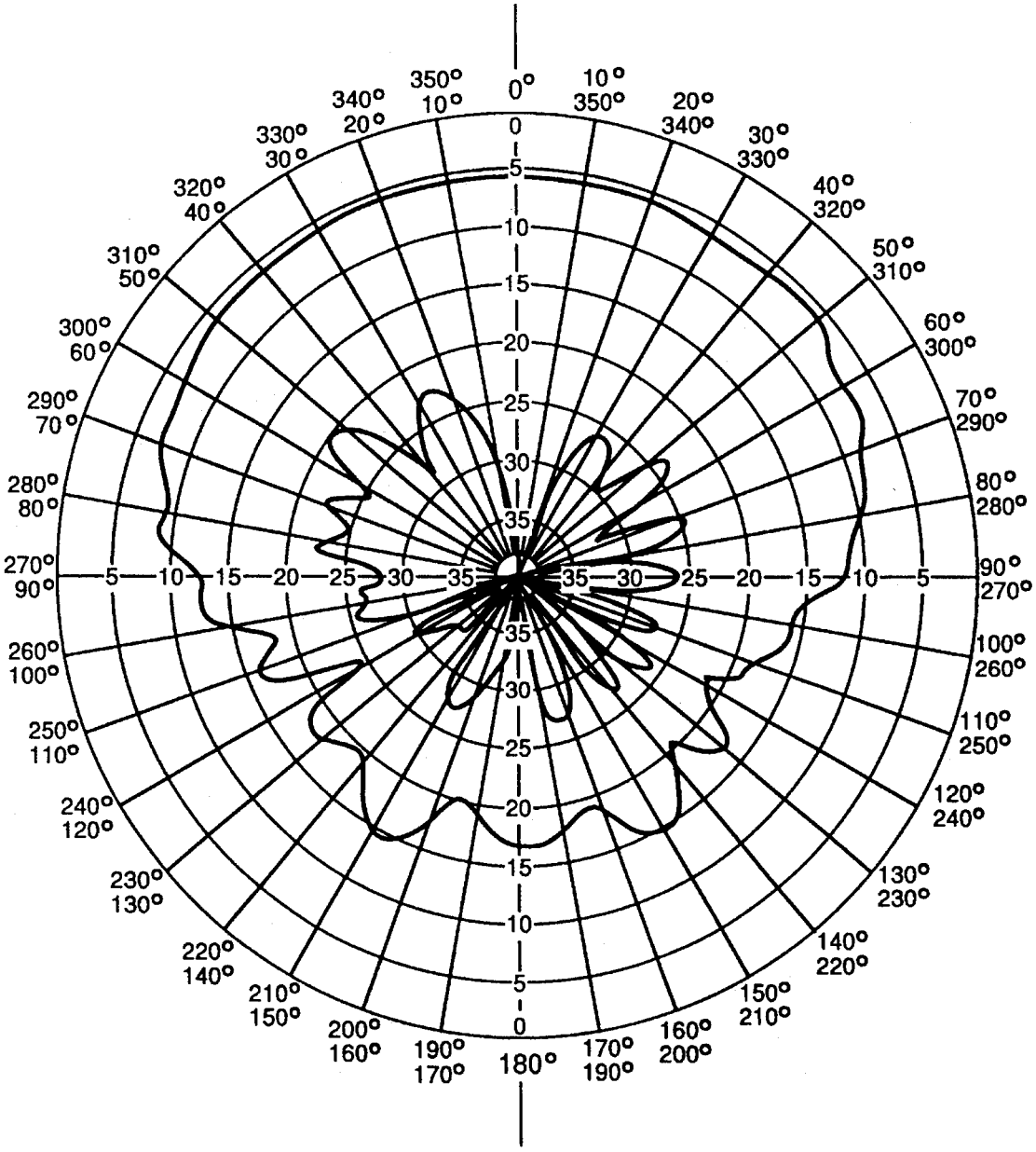

An antenna of the configuration shown in FIG. 1 was made and tested. The measured impedance of the antenna is shown in. FIGS. 3A and 3B. The self impedance of this antenna is less than a 1.5:1 VSWR (when properly matched) over a band width of 700 to 2000 MHz. Radiation patters for a single element are shown in FIGS. 4 to 8. The narrow beam width in the E-Plane at the higher frequency could be broadened by truncating the taper. Truncating the taper reduces the low frequency impedance bandwidth, but adequate low frequency performance is still provided.

Figure 2:
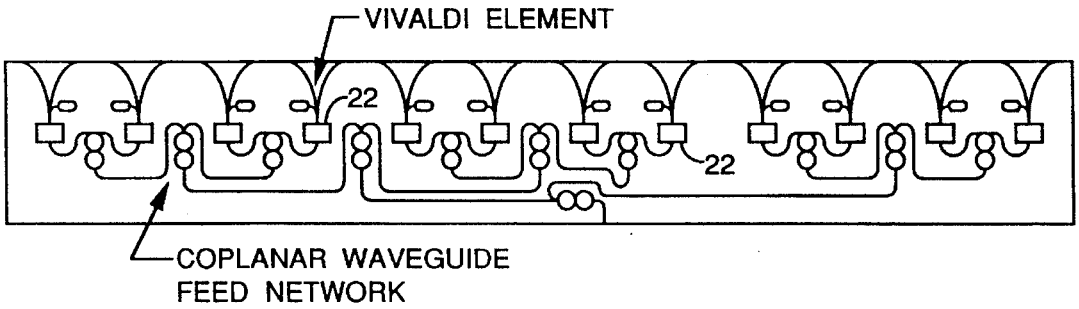
FIG. 2 shows the radiating elements in a sub-array.

The single antenna unit 10 is intended for use in an antenna array. FIG. 2 shows one sub-array 26 in which 12 antenna units 10 are incorporated. The sub-array shown in FIG. 2 comprises the 12 Vivaldi elements are each fed from a coplanar waveguide feed network 26 through a T-R box 28. It is clear from the showing in FIG. 2 that most of the area of the very thin substrate on which the copper conductor is deposited is covered to provide support for the substrate. Except for the application of the coating to the substrate, the substrate is not self supporting.

The performance characteristics of the antenna are shown in FIGS. 3–8 which are self-explanatory.

It will be understood that the subarrays are incorporated into by large arrays of such elements to provide an antenna suitable for a space based radar.

While this invention is subject to various modifications and adaptations, it is intended that it be limited in scope only by the appended claims, as interpreted in the light of the prior art.

What is claimed is:

1. The combination comprising:

a broadband radiating tapered notch antenna, said antenna comprising a thin, flexible, non-self-supporting dielectric film, a conductive metallic layer coated on said film, the combination of said film with said layer thereon being rigidly self supporting, said layer being formed to define said tapered notch antenna, a section of slotline, a coplanar waveguide and an infinite balun, all of which are coplanar, radio frequencies being applied to said antenna through said slot line via said coplanar waveguide to the slotline being accomplished by said infinite balun.

2. The combination as defined in claim 1 wherein said conductive metallic coating is copper, and wherein said film is a ceramic PTFE composite and the combination of said coating and said film is self-supporting.

* * * * *

UNITED STATES PATENT AND TRADEMARK OFFICE

CERTIFICATE OF CORRECTION

PATENT NO. : 5,519,408

DATED : May 21, 1996

INVENTOR(S) : Michel W. Schnetzer

It is certified that error appears in the above-indentified patent and that said Letters Patent is hereby corrected as shown below:

On the title page, insert item [73] Assignee --United States of America as represented by the Secretary of the Air Force--.

On the title page, after "Assistant Examiner" insert, Attorney, Agent or Firm --Donald J. Singer & Irwin P. Garfinkle--.

Signed and Sealed this

Twenty-second Day of October, 1996

*Attest:*

BRUCE LEHMAN

*Attesting Officer*

*Commissioner of Patents and Trademarks*